US008809655B1

(12) United States Patent
Warwick

(10) Patent No.: US 8,809,655 B1
(45) Date of Patent: Aug. 19, 2014

(54) MULTI-FUNCTIONAL CAPO APPARATUS AND METHOD OF USE

(71) Applicant: Gary Warwick, Phelan, CA (US)

(72) Inventor: Gary Warwick, Phelan, CA (US)

( * ) Notice: Subject to any disclaimer, the term of this patent is extended or adjusted under 35 U.S.C. 154(b) by 0 days.

(21) Appl. No.: 13/804,863

(22) Filed: Mar. 14, 2013

(51) Int. Cl.
*G10D 3/00* (2006.01)

(52) U.S. Cl.
USPC ..... 84/318

(58) Field of Classification Search
USPC ..... 84/315–318
See application file for complete search history.

(56) References Cited

U.S. PATENT DOCUMENTS

| | | | | |
|---|---|---|---|---|
| 4,143,576 | A | 3/1979 | Nichols | |
| 4,583,440 | A | 4/1986 | Powell, Jr. | |
| D378,825 | S | 4/1997 | Dunlop | |
| 5,623,110 | A * | 4/1997 | Hoglund et al. | 84/318 |
| 7,012,181 | B2 * | 3/2006 | Tran | 84/318 |
| D573,629 | S | 7/2008 | Steinberger | |
| D574,416 | S | 8/2008 | Small | |
| 2007/0143929 | A1 | 6/2007 | Selin | |
| 2009/0064842 | A1 | 3/2009 | Small | |
| 2010/0269666 | A1 | 10/2010 | D'Addario | |

* cited by examiner

*Primary Examiner* — Kimberly Lockett
(74) *Attorney, Agent, or Firm* — One3 IP Management, P.C.; Jeromye V. Sartain

(57) ABSTRACT

A capo apparatus for use on a stringed instrument comprising a capo body comprising a first leg having a first leg width thereacross, and an attachment extending from the capo body comprising an attachment body having an attachment first width associated with a vertical portion thereof and an attachment second width associated with a horizontal portion thereof, the attachment second width being greater than the first leg width. The attachment may be removably engaged with capo body or be integral therewith. A power source and a light source may be operably installed within the capo apparatus for selectively lighting at least a portion of the attachment body.

20 Claims, 10 Drawing Sheets

MULTI-FUNCTIONAL CAPO APPARATUS AND METHOD OF USE

BACKGROUND OF THE INVENTION

Related Applications

Not applicable.

INCORPORATION BY REFERENCE

Applicant(s) hereby incorporate herein by reference any and all U.S. patents and U.S. patent applications cited or referred to in this application.

FIELD OF THE INVENTION

Aspects of this invention relate generally to guitar capos, and more particularly to a multi-functional capo.

DESCRIPTION OF RELATED ART

The following art defines the present state of this field:

U.S. Pat. No. 4,143,576 to Nichols is directed to a fretted neck of a guitar having a plurality of strings spaced above the fret board and a capo selectively movable along the length of the neck for retaining all of the strings in abutting relationship to the fretboard. The capo includes a clamp frame having a generally horizontally extending portion that mounts a retainer bar and a generally vertically extending portion, a finger operated clamp member, and a torsion spring mounting the clamp member on the clamp frame and resiliently urging it to a clamping position, and the torsion spring being mounted on the clamp frame. In one embodiment the retainer bar mounts a roller for each string while in a second embodiment the retainer bar mounts rollers with one of the rollers being of a length to extend across two strings. In a third embodiment the retainer bar mounts two plastic inserts that have downwardly extending rectangular teeth for holding the guitar strings against the fretboard.

U.S. Pat. No. 4,583,440 to Powell, Jr. is directed to a capo for a guitar and five string banjo that is selectively mounted along the length of the guitar or five string banjo neck for retaining all of the strings of the guitar or four of the five strings of a five string banjo in abutting relation to the frets of the fretboard for the purpose of uniformly changing the pitch of the strings without the need for retuning the strings. The capo consists of a clamp frame that mounts a rubber strip for clamping against the strings and two integral handles that are grasped using either hand for operation and a coiled tension spring to provide the clamping force.

U.S. Design Pat. No. D378,825 to Dunlop is directed to the ornamental design for a trigger capo, as shown and described.

U.S. Design Pat. No. D574,416 to Small is directed to the ornamental design for a capo, as shown and described.

U.S. Patent Application Publication No. 2009/0064842 to Small is directed to a capo for use with a stringed musical instrument including a frame that includes a first arm configured to extend across a neck of the instrument, and a second arm connected to the first arm and extending from the first arm at a first angle less than 180°, further including a pivot arm that is substantially Y-shaped, including base, actuator, and clamp portions, all pivotally connected to the frame to move between open and closed positions, a proximal end of the clamp portion connected to the distal end of the base portion, the clamp portion extending away from the base portion toward the first arm when the pivot arm is in the closed position, the base portion being biased away from the second arm such that the clamp portion is biased toward the first arm.

U.S. Design Pat. No. D573,629 to Steinberger is directed to the ornamental design for a capo, as shown and described.

U.S. Patent Application Publication No. 2010/0269666 to D'Addario is directed to a combination of a capo with attached tuner having a sensor that picks up vibrations through the capo. The capo and tuner are connected together as a unitary accessory that is attachable along the neck of the guitar, in the manner of a conventional capo, but with the significant advantage of automatic and continuous visibility of the tuner display while tuning at a particular capo position and while pausing between songs.

U.S. Patent Application Publication No. 2007/0143929 to Selin is directed to a combination device that includes a capo for a stringed musical instrument such as a guitar or a banjo, and a beverage bottle and/or can opener integrally coupled to the capo. In various aspects of the embodiment, the container opener is an integral part of either a finger board-engaging portion, a neck-engaging portion or a tensioning member of the capo. In an alternative aspect, the container opener portion of the capo is a container surface-puncturing element, also commonly known as a church key.

U.S. Pat. No. 7,012,181 to Tran is directed to a capo system for incorporating the advantages of a spring loaded short cut capo and a spring loaded regular capo into one convenient spring loaded capo system, while maintaining the ability to move both capos with one hand and improving the comfortability when squeezing the capo by incorporating padding and comfort grooves. The inventive device includes a regular spring loaded capo with top and bottom jaws and a protruding portion, a spring loaded short cut capo with top and bottom jaws and a protruding portion and a plurality of attachments that connect both spring loaded capos together. The short cut capo consists of a spring loaded capo that is altered in a way to allow the certain strings on a guitar to be remained unclamped, while the remainder of the strings are closed down. The regular spring loaded capo is a spring loaded capo that is unaltered to ensure proper closing down on all strings of a guitar. The regular capo and short cut capo are connected to each other by a plurality of attachments that provide stability and support during the simultaneous opening and closing of both capos and ensure that both capos remain at a preset fixed distance from each other. The plurality of attachments may also include elastomeric pads and grooves to increase comfortability and support when squeezing the plurality of attachments.

The prior art described above teaches capos, a trigger capo, a capo for guitar and banjo, a spring capo, a tuner with capo, a combination capo-container opener device, and a capo system, but does not teach a capo apparatus configured for multi-functional use as through the incorporation of a removable or integral attachment. Aspects of the present invention fulfill these needs and provide further related advantages as described in the following summary.

SUMMARY OF THE INVENTION

Aspects of the present invention teach certain benefits in construction and use which give rise to the exemplary advantages described below.

The present invention solves the problems described above by providing a multi-functional capo apparatus for use on a stringed instrument. The apparatus provides, in the exemplary embodiment, a capo body comprising a first leg having a first leg width thereacross, and an attachment extending from the capo body comprising an attachment body having an attachment first width associated with a vertical portion thereof and an attachment second width associated with a horizontal portion thereof, the attachment second width being greater than the first leg width.

A primary objective inherent in the above described apparatus and method of use is to provide advantages not taught by the prior art.

Another objective is to provide such an apparatus wherein the attachment is removably engaged with the capo body.

A further objective is to provide such an apparatus wherein a power source and a light source are operably installed within the capo apparatus for selectively lighting at least a portion of the attachment body.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

The above described drawing figures illustrate aspects of the invention in at least one of its exemplary embodiments, which are further defined in detail in the following description.

Features, elements, and aspects of the invention that are referenced by the same numerals in different figures represent the same, equivalent, or similar features, elements, or aspects, in accordance with one or more embodiments.

DETAILED DESCRIPTION OF THE INVENTION

The above described drawing figures illustrate aspects of the invention in at least one of its exemplary embodiments, which are further defined in detail in the following description.

By way of background and for context, a capo is a tool or device known in the art that clamps a bar across the strings of a guitar, banjo, or other such stringed instrument to effectively raise the pitch of the instrument. A capo is often used by guitarists to play in a different key without changing the chords played. The present invention relates to such capos having integral or selectively removable attachments that may be decorative and/or functional. Therefore, as a threshold matter, it is to be appreciated that any capo now known or later developed capable of selectively clamping one or more strings of a stringed instrument may be employed in connection with aspects of the present invention without departing from its spirit and scope, such that the particular exemplary constructions or configurations of the finger board-engaging portion, neck-engaging portion, and tensioning member of the capos shown and described are to be understood as non-limiting and generally beyond the scope of the present invention.

Figure 1:
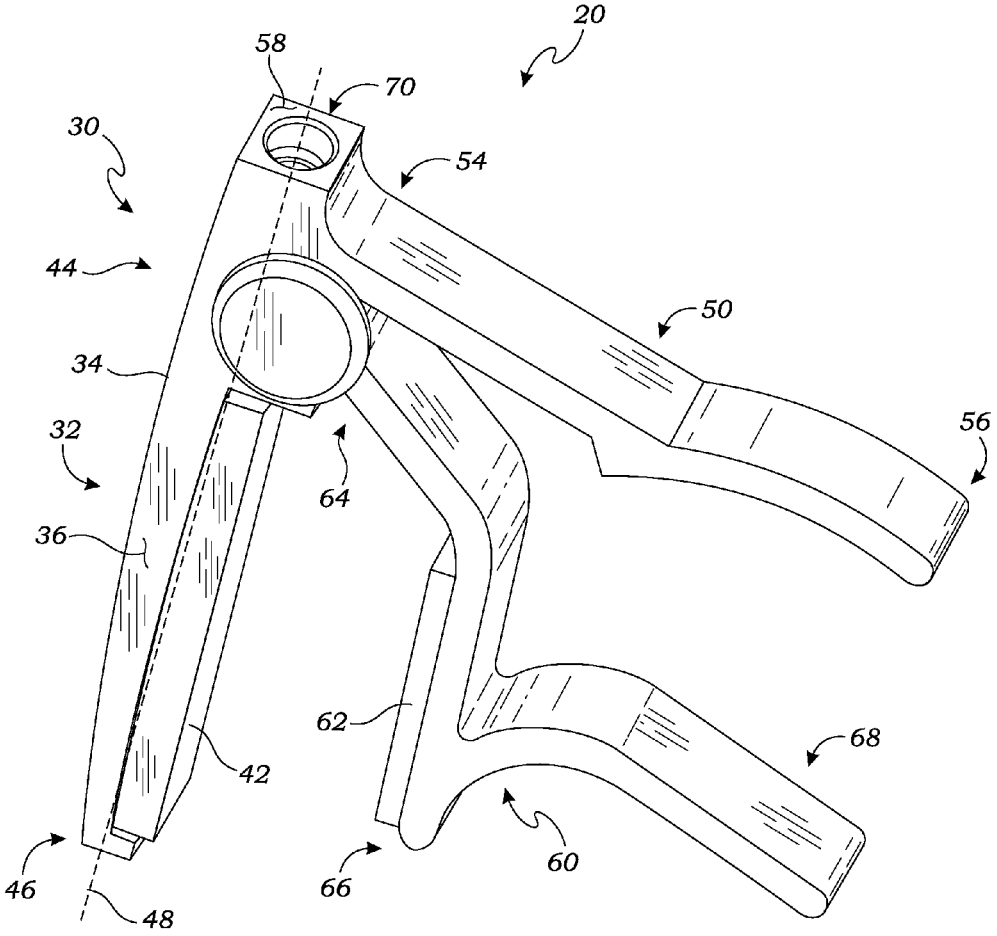
FIG. 1 is a perspective view of an exemplary embodiment of the invention.

Turning now to FIG. 1, there is shown a perspective view of an exemplary embodiment of a capo apparatus 20 according to aspects of the present invention. The apparatus 20 generally comprises a capo body 30 and an integral pivotal arm 60 and a means for removably engaging an attachment 110 (FIGS. 2-11) with the capo body 30. In the exemplary embodiment of FIG. 1 the engagement means is configured as a hole 70 formed in the capo body top surface 58. As will be appreciated in view of the alternative exemplary embodiments shown in FIGS. 8-11, any other removable engagement means now known or later developed, including but not limited to threads, press or interference fits, keyed slots, mechanical fasteners or clips, snaps, and hook-and-loop fasteners, may be employed in the present invention without departing from its spirit and scope. In the exemplary embodiment, the capo body 30 is formed having a first leg 32 and a substantially perpendicular second leg 50; more particularly, the first and second legs 32, 50 being joined substantially at the proximal ends 44, 54 thereof. The first leg is further formed toward its opposite distal end 46 with a substantially inwardly facing first leg pad 42, such pad 42 being positioned on the first leg 32 substantially opposite a first leg front surface 34. Extending from the capo body 30 is an arm 60 pivotally installed on the capo body 30 substantially at its proximal end 64 substantially adjacent to the first and second leg proximal ends 44, 54, the arm 60 being formed toward its distal end 66 with a substantially inwardly-facing arm pad 62. It will be appreciated that the first leg and arm pads 42, 62 are thus configured to face one another and in use of the capo apparatus 20 to clamp on the fret board F and neck N of a guitar G (FIG. 19) in a manner known in the art for changing the pitch or key of the instrument. Accordingly, as is also known in the art, the arm 60 may be biased toward the first leg 32 as by a spring or other device (not shown) for the purpose of clamping the capo apparatus 20 on the guitar neck N during use and may further be provided with an arm handle 68 configured to extend substantially parallel to and in the direction of the second leg 50 for the purpose of grasping the respective appendages for selectively pivoting the arm 60 against the resistance of the spring (not shown) for clamping and unclamping the capo apparatus 20 in a manner known in the art. In an exemplary embodiment, each of the first leg and arm pads 42, 62 are selectively removable from the respective first leg 32 and arm 60 so as to be replaceable. Once again, those of ordinary skill in the art will appreciate that while one or more exemplary configurations of the capo apparatus 20 are shown and described, particularly as to its legs 32, 50 and arm 60, the invention is not so limited, but instead may take numerous forms employing a variety of components now known or later developed that are analogous or substantially functionally equivalent without departing from the spirit and scope of the invention.

Figure 2:
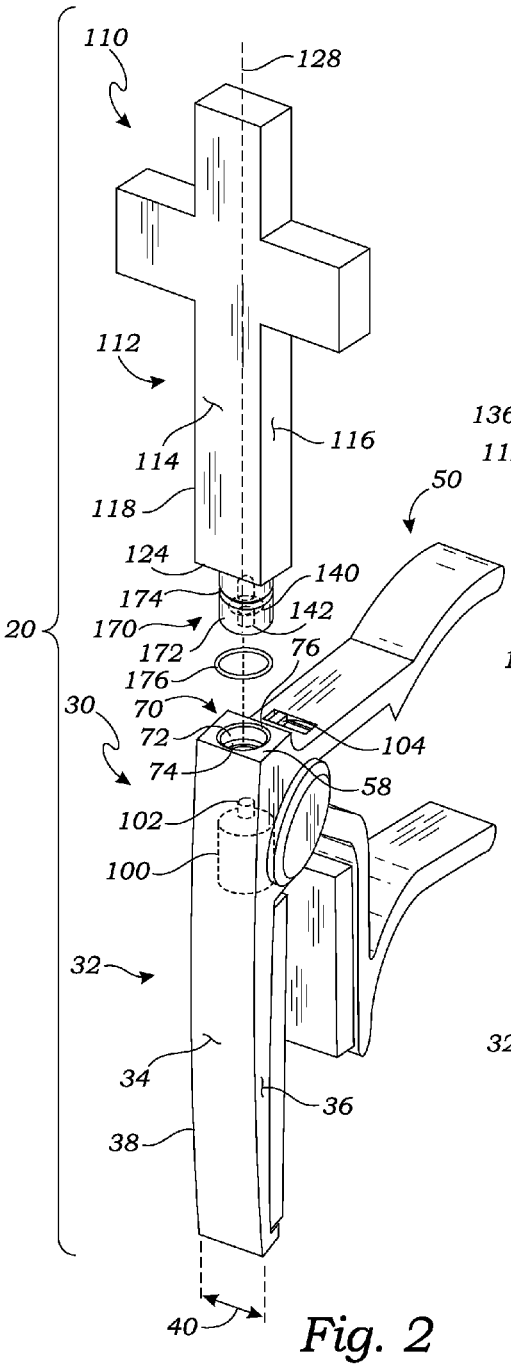
FIG. 2 is a reduced scale exploded perspective view thereof in conjunction with an exemplary first attachment thereof.
Figure 3:
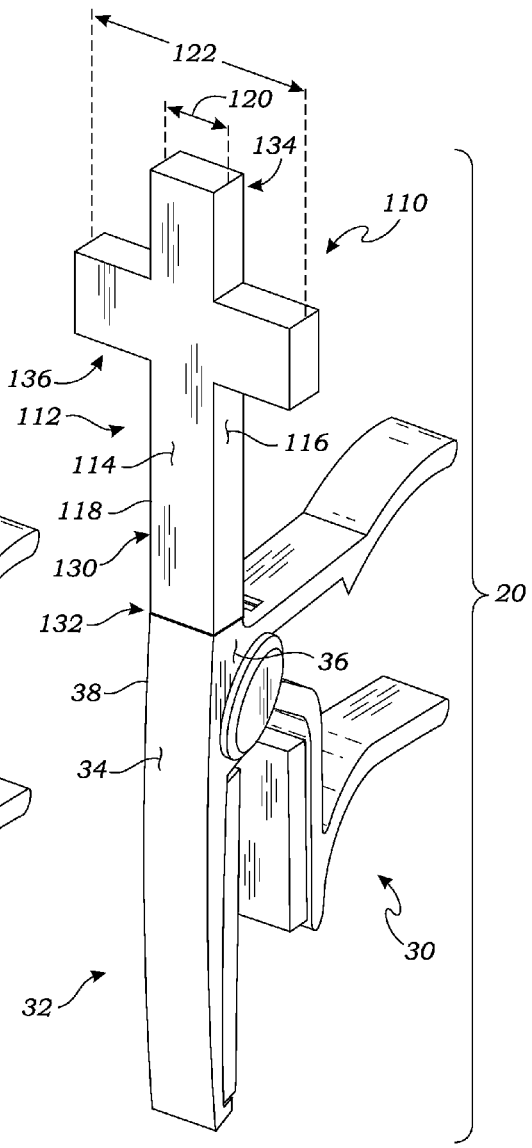
FIG. 3 is a perspective assembled view thereof with the exemplary first attachment of FIG. 2.

Referring now to FIGS. 2 and 3, there are shown exploded and assembled perspective views, respectively, of a capo apparatus 20 according to aspects of the present invention wherein an attachment 110 is removably engaged with or installed on the capo body 30. The capo body 30 is once again shown as having a hole 70 formed in its top surface 58 substantially centered on or coaxial with the capo first leg axis 48 (FIG. 1), the hole 70 having a substantially annular hole wall 72 formed with a circumferential hole groove 74. A mating post 170 is formed so as to extend from the bottom surface 124 of the attachment 110, the post 170 having a substantially annular post wall 172 and configured to nest within the hole 70 such that the hole and post walls 72, 172 are substantially adjacent. A hole chamfer 76 may be formed at the intersection of the hole wall 72 and the capo body top surface 58 to break the corner and assist guiding the post 170 into the hole 70 in a manner known in the art. A circumferential post groove 174 is formed in the post wall 172, and an o-ring 176 is provided to seat within the respective hole and post grooves 74, 174 when the post 170 is inserted within the hole 70. It will be appreciated that the o-ring 176 may first be seated in either the hole groove 74 or the post groove 174 in a manner known in the art and that other means for providing effectively an interference fit for assembly and retention of the attachment 110 on the capo body 30 may also be employed. Relatedly, while grooved surfaces 72, 172 with an engagement o-ring 176 are shown and described, other surfaces for temporarily mechanically engaging the components may also be employed, such as forming male or external threads (not shown) on the post 170 and corresponding female or internal threads (not shown) within the hole 70 in a manner known in the art for threadable engagement of the attachment 110 on the capo body 30. It will be further appreciated that while an annular hole 70 and post 170 are shown and described, other geometries of these mating components may instead be employed, such as non-annular mating surfaces for the purpose of keying or indexing the attachment 110 relative to the capo body 30. Moreover, the locations of any such hole 70 and post 170 may vary or even be reversed from that shone, such that the hole 70 could be formed in the attachment 110 and the post 170 on the capo body 30. In the exemplary embodiment, the dimensions of the hole 70 and the post 170, or the depth of the hole 70 and length of the post 170, and the positions of the grooves 74, 174 and thus o-ring 176 are such that when the attachment 110 is removably engaged with the capo body 30, the capo body top surface 58 and the attachment bottom surface 124 are substantially flush as shown in FIG. 3. Moreover, with continued reference to FIGS. 2 and 3, the first leg 32 is formed having a first leg front surface 34, a first leg right side surface 36, and a first leg left side surface 38, the first leg right and left side surfaces 36, 38 defining a first leg width 40 effectively across the first leg front surface 34. Similarly, the attachment 110 comprises an attachment body 112 formed having an attachment front surface 114, an attachment right side surface 116, and an attachment left side surface 118, the attachment right and left side surfaces 116, 118 defining an attachment first width 120 effectively across the attachment front surface 114. In the exemplary embodiment, the first leg width 40 and the attachment first width 120 are substantially equal and the first leg axis 48 (FIG. 1) and the attachment axis 128 are substantially aligned, or the attachment 110, and particularly the vertical portion 130, and the capo first leg 32 are substantially coaxial, so as to give the front of the assembled capo apparatus 20 a substantially continuous look when the attachment 110 is installed on the capo body 30 as again shown in FIG. 3. Those skilled in the art will appreciate that such considerations are both functional and aesthetic and that, in any event, other such geometries and resulting looks may be employed in the capo apparatus 20 of the present invention without departing from its spirit and scope. Specifically, while the first leg axis 48 and the attachment axis 128 are shown and described as being substantially aligned in the exemplary embodiment and each such axis substantially running the length of the respective first leg 32 and the attachment body vertical portion 130, it will be appreciated that the actual profiles of the first leg 32, and the capo body 30 more generally, and the attachment body vertical portion 130, and the attachment body 112 more generally, may be curved or non-planar and so diverge away from the aligned relationship at the proximal ends 44, 132 of the respective first leg 32 and attachment body vertical portion 130 without departing from the spirit and scope of the invention, such that any attachment 110 having features that extend or curve out of the plane of the first leg 32 and vertical portion 130 and so not being said to be any longer aligned therewith is nevertheless aligned for the purpose of describing the relationship between the components. Similarly, an attachment 110 that commences at some angle to the first leg axis 48 but that then curves so as to be substantially parallel to the first leg axis 48 can still be said to be substantially aligned with the first leg 32. Relatedly, it will be appreciated that while the front and side surfaces of the respective capo body and attachment are shown as being substantially square, they need not be so, both in terms of the geometries of the respective components and in view of the attachment 110 being rotatable on the capo body 30 in the exemplary embodiment. As such, and by way of further example, it will be appreciated that the attachment 110 can be configured to be installed or extend off-axis or out of plane with the capo body 30, and the capo first leg 32, particularly, and can essentially be placed anywhere on the capo body 30 that would not practically interfere with the playing of the guitar G (FIG. 19) or other stringed instrument such that the orientation of the attachment 110 relative to the capo body 30 in the exemplary embodiments is again to be understood as illustrative and non-limiting. Furthermore, while one attachment 110 and a single removable engagement means such as the hole 70 are shown, it will also be appreciated that in alternate versions of the apparatus 20, and the capo body 30, specifically, multiple attachments 110 and provisions for their engagement with the capo body 30 may be provided as well.

Regarding the materials and methods of fabrication or construction of the exemplary capo apparatus 20, fundamentally, it will be appreciated by those skilled in the art that any suitable material and manufacturing method now known or later developed may be employed without departing from the spirit and scope of the invention. By way of illustration, the capo body 30 and/or attachment 110 may be formed of extruded or machined metal such as aluminum or injection-molded plastic such as polycarbonate. Such components may then be finished in a number of ways, with particularly metal components being polished, such as by centrifugal barrel finishing, or anodized, for example. Plastic or metal components may also be finished through metalizing, plating, physical or chemical vapor deposition, coating, painting, powdercoating, over-molding, graphics application, or any other such surface finishing technique now known or later developed. The colors, finishes, and appearances of the capo body 30 and the attachment 110 may be substantially the same or substantially different.

Figure 19:
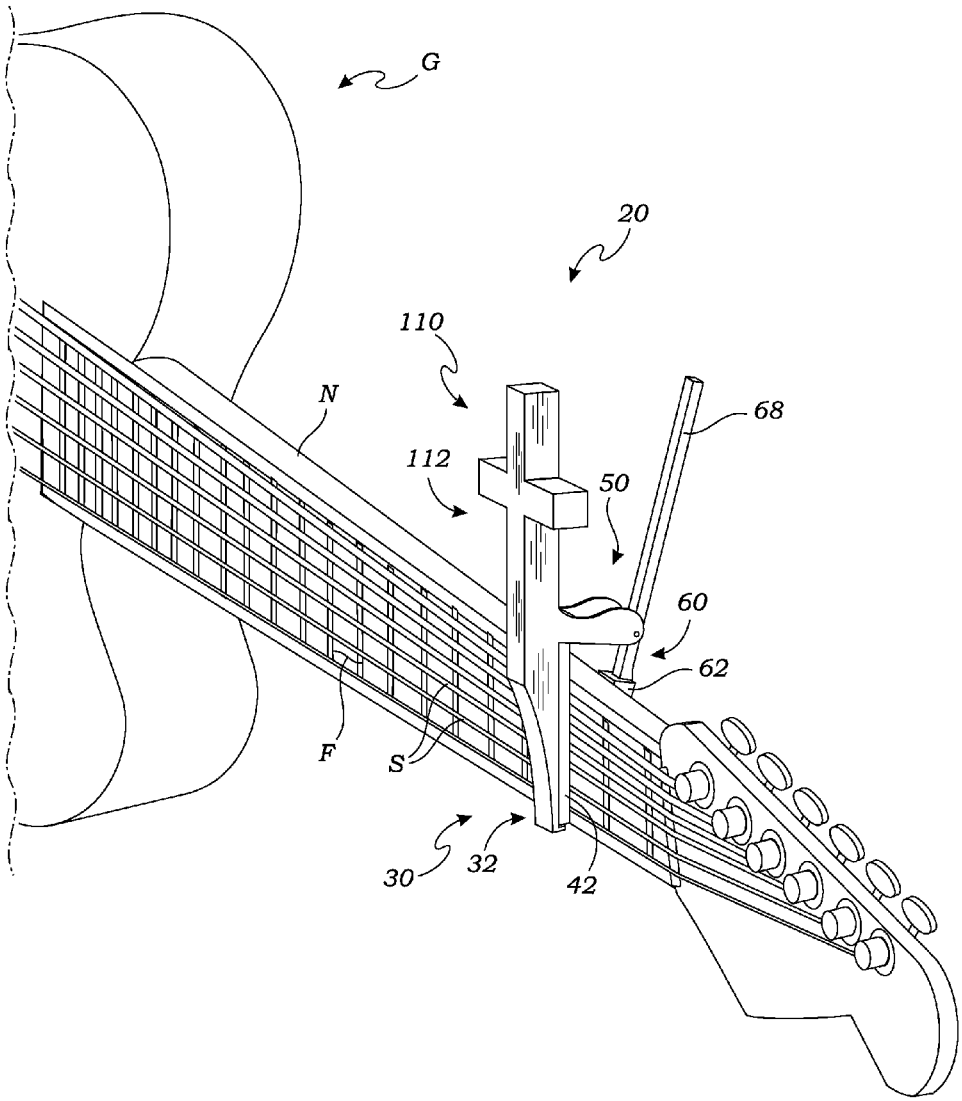
FIG. 19 is a perspective view thereof in use.

With continued reference to FIG. 2, there is also shown an alternate exemplary embodiment having a power source 100 installed within the capo body 30 and a light source 140 installed within the attachment body 112. In more detail, a power source 100 such as a battery may be removably installed within the first leg 32 as shown. The power source 100 may be inserted to such a depth and in such a manner within the first leg 32 that an upwardly-projecting power source terminal 102 may either protrude into the hole 70 or may contact a contactor (not shown) that itself at least partially extends into the hole 70. Further, the light source 140 may be installed within particularly the post 170 of the attachment body 112 such that a downwardly-projecting light source terminal 142 may extend proximally from the post 170, whereby when the attachment 110 is installed on the capo body 30 as by seating the post 170 within the receiving hole 70, the power source terminal 102 may be brought into electrical communication with the light source terminal 142, directly or indirectly as through a contactor (not shown), such that the power source 100 powers the light source 140 causing it to emit light. Such light emittance may be constant, intermittent, or selectively controlled through a power switch 104. That is, the light source 140 may simply always be powered when the attachment 110 is installed on the capo body 30, so that the light source 140 may either simply always be "on" when the components are engaged or may operate or illuminate intermittently so as to "flash" or "pulse" as under the control of a microprocessor or other controller (not shown), whether based on a timer or in direct response to the strings S of the guitar G when the capo apparatus 20 is installed thereon as shown in FIG. 19. Specifically, in connection with the light source 140 operating intermittently as based on a timer, it will be appreciated that it may be configured, again under the control of a microprocessor or the like with a selectively employed switch 104 or the like, to flash or pulse at a set frequency or tempo much like a metronome. As such, in a further alternative embodiment, the capo apparatus 20 may be equipped with an audible source (not shown) for making audible beeps along with or instead of the light pulses from the light source 140, again, much like a metronome, here uniquely integral with or removably engaged with the capo apparatus 20. Furthermore, the light source 140, even while powered as through the installation of the attachment 110 on the capo body 30, may be controlled through a switch 104 or the like. Such a switch 104 may operate to selectively turn the light source 140 "on" or "off" even when the attachment 110 is installed or to selectively change the mode of operation of the light source 140 (e.g., always on, flashing, strumming-based, etc.). Any such switch or other electrical control now known or later developed may be employed according to aspects of the present invention, and its location as being substantially at the proximal end 54 (FIG. 1) of the second leg 50 is also to be understood as merely exemplary. The light source 140 may be any bulb or bulb unit now known or later developed for emitting visible light, including but not limited to an LED bulb. It will be appreciated that in embodiments wherein the capo apparatus 20 is configured with a power source 100 and a light source 140 as herein described or any other substantially functionally equivalent components now known or later developed, it is preferable that all or at least a portion, such as front surface 114, of the attachment body 112 be translucent, or allow at least some light to pass through. Such translucency may be relatively high, as tending toward being clear or transparent, or may be relatively low, as tending toward diffusion of the light. Again, substantially the entire attachment body 112 may be translucent so as to allow light from the light source 140 positioned substantially within the post 170 to escape substantially throughout the attachment body 112, or one or more surfaces of the attachment body 112, such as the attachment front surface 114 or a portion thereof may be formed to be translucent. Accordingly, the attachment body 112 may be formed as a solid member comprised throughout of an appropriate material offering some degree of translucency or as an at least partially hollow member wherein one or more walls thereof are again translucent to some extent. In any case, those skilled in the art will appreciate that light from the light source 140 may thus pass up through and out of an attachment body 112 so configured so as to offer further functional and aesthetic qualities of the capo apparatus 20 according to aspects of the present invention. In a further alternative embodiment the power source 100 and/or light source 140 may be positioned within the second leg 50 of the capo body 30. Or, in a still further alternative embodiment, the second leg 50 may effectively be the light source 140 in the form of a flashlight threadably or otherwise engaged with the capo body 30, and the first leg 32 specifically, so as to, once in position, be operated to selectively illuminate within the first leg 32 and/or the attachment 110.

With reference to FIG. 3 once again, the exemplary attachment 110, and particularly the attachment body 112, is shown as being configured in the form of a cross. Particularly, the vertical portion 130 of the attachment body 112 is representative of the typical vertical cross beam, and an attachment horizontal portion 136 formed so as to span the vertical portion 130 between its proximal and distal ends 132, 134, respectively, closer to the distal end 134, is representative of the typical horizontal cross beam. Notably, the horizontal portion 136 defines a second width 122 of the attachment body 112 that is greater than the first width 120 of the attachment body 112 associated with the vertical portion 130 thereof. As such, at least a portion of the attachment body 112 extends horizontally, or in a direction or plane substantially perpendicular to that of the axis 48 of the capo body first leg 32 or substantially parallel to the neck N and strings S of the guitar G (FIG. 19), beyond the width 40 of the capo first leg 32. It will be appreciated that such structure is not so readily accomplished or formed in the typical extrusion-forming process of conventional capos, whereby the capo is profiled by the extrusion process to a net or near net shape and the individual components are sliced off the end of the extruded bar like bologna; in such a process, it is relatively easy to add features in the plane of the capo cross-section or profile, while to add features perpendicular to and extending from the profile of the capo is quite difficult, or at least does not lend itself to the relatively expedient extrusion process, thus requiring a different manufacturing process and/or secondary operation, the overall width of the main capo being dictated primarily by such practicalities as the distance between the frets on a guitar and not interfering with playing the instrument. As such, those skilled in the art will appreciate that particularly the removable engagement of an attachment 110 such as set forth herein with the capo body 30 lends itself to still relatively more expedient production of the capo body 30 while still providing a wide and virtually limitless variety of geometries of attachments 110 so as to thereby achieve new and novel functional and aesthetic benefits according to aspects of the capo apparatus 20 of the present invention.

Figure 4:
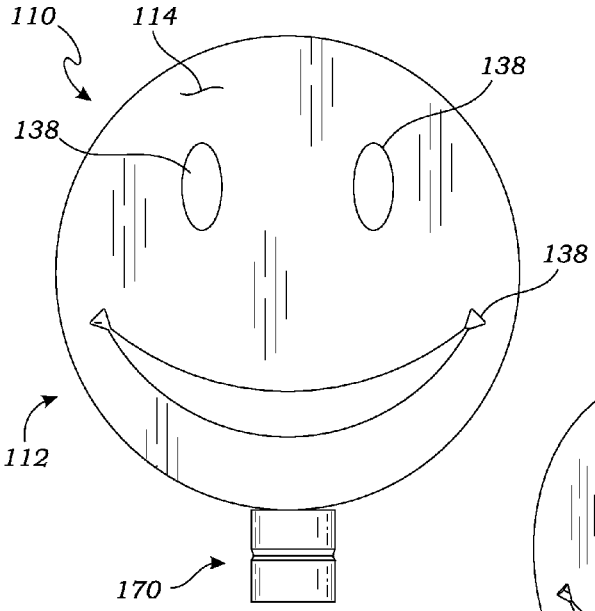
FIG. 4 is a front view of an exemplary second attachment thereof.
Figure 5:
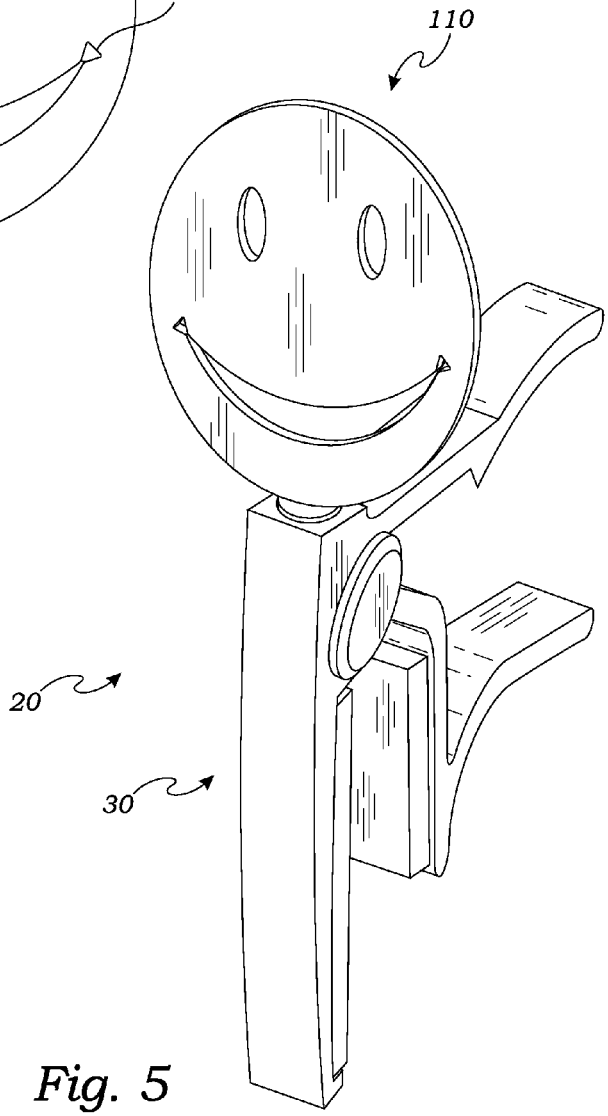
FIG. 5 is a perspective assembled view thereof with the exemplary second attachment of FIG. 4.

Turning now to FIGS. 4 and 5, and by way of further illustration of the features and aspects of the capo apparatus 20 of the present invention, there is again shown a capo body 30 substantially the same as that of FIG. 1 having a hole 70 formed in a top surface 58 thereof. (FIG. 1). Here, the attachment 110 is again formed having a post 170 for removably and rotatably engaging the hole 70 (FIG. 1) of the capo body 30, but the attachment body 112 is otherwise formed effectively without separate vertical and horizontal portions 130, 136 (FIG. 3) as in the "cross" capo attachment and instead effectively having integral horizontal and vertical portions in the form of a substantially planar attachment front surface 114. In the exemplary embodiment, such attachment 110, and the attachment body 112 and its front surface 114 particularly, is configured to be substantially annular and have the look of or have applied or formed thereon a "smiley face" indicia 138 such that there are also not defined right and left side surfaces 116, 118 as in the exemplary embodiment of FIGS. 2 and 3. It will be appreciated that the attachment 110 can take virtually any size or shape and have formed or placed thereon a virtually infinite variety of indicia, whether machined or molded, painted, or applied as by a graphic overlay, sticker, or other such surface treatment, such that the representative "smiley face" shape and indicia 138 is to be understood as illustrative and non-limiting.

Figure 6:
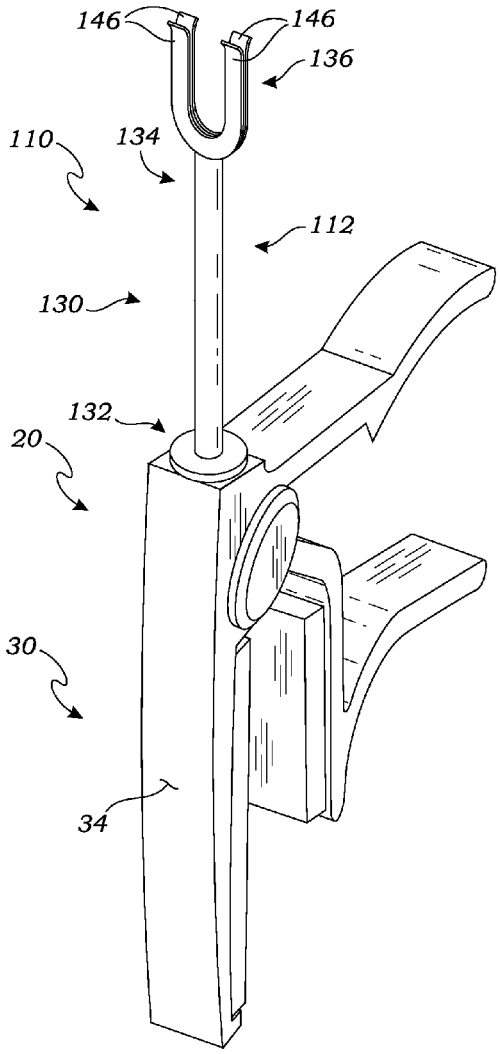
FIG. 6 is a perspective assembled view thereof with an exemplary third attachment in a first operational mode.
Figure 7:
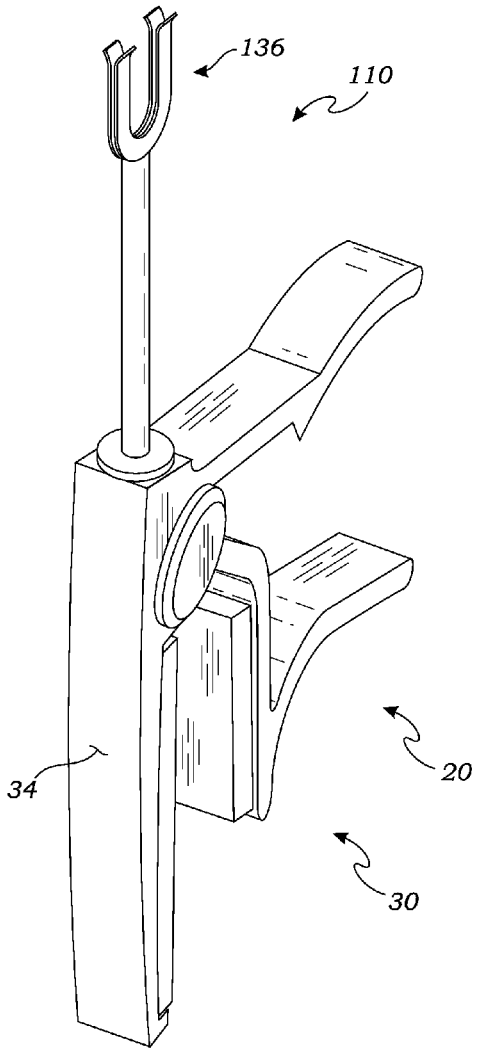
FIG. 7 is a perspective assembled view thereof with the exemplary third attachment in a second operational mode.

Referring next to FIGS. 6 and 7, there is shown a still further illustration of the features and aspects of the capo apparatus 20 of the present invention, here once more relating to the exemplary capo body 30 as shown in FIG. 1. The attachment 110 is formed effectively as a clip that can be used to hold items such as a song list, chord chart or music, a picture, or any other such item. Specifically, the alternative exemplary attachment 110 has its body 112 formed having a vertical portion 130 in the form of a rod extending from a proximal end 132, at which is again formed a substantially annular post 170 (FIG. 2) for removably and rotatably engaging the hole 70 (FIG. 1) of the capo body 30, to an opposite distal end 134, at which is formed the horizontal portion 136 here configured as a clip. While the alternative clip attachment 110 is shown as being of a particular size and shape, such as comprising opposite resilient tines 146, any other such clip, clamp or other such device for holding an object relative to the capo body 30 may be employed without departing from the spirit and scope of the invention. Further, as shown in FIG. 6, in a first operational mode the attachment 110 may be positioned on the capo body 30 such that the horizontal clip portion 136 is substantially parallel to the plane of the capo front surface 34, as when a picture or other item (not shown) placed within the clip so as to be substantially vertical is to be viewed or viewable by a person other than the one playing the guitar G (FIG. 19). And as shown in FIG. 7, in a second operational mode the attachment 110 may be positioned on the capo body 30 such that the horizontal clip portion 136 is rotated to be substantially perpendicular to the plane of the capo front surface 34, or in some other intermediate position angularly displaced from the plane of the capo front surface 34, so that a song list, music, or other such item placed within the clip so as to be substantially vertical is to be viewed or viewable by the person playing the guitar G (FIG. 19). Relatedly, in an alternate embodiment the vertical portion 130 is configured as or from goose neck tubing or any other such flexible tubing now known or later developed whereby the clip portion formed by the resilient tines 146 may be selectively oriented rotationally, vertically and/or horizontally out of the plane of the first leg 32 of the capo body 30 for selective positioning of the clip or other device at the distal end 134 of the vertical portion 130 so that an object held therein may be more readily viewed by the person playing the guitar G (FIG. 19) or some other person as desired. Once more, it will be appreciated by those skilled in the art that a number of other variations of the clip attachment 110 may be employed in a capo apparatus 20 according to aspects of the present invention without departing from its spirit and scope. For example, and by way of further illustration of features and aspects of the present invention, such an attachment 110 similar to that of FIGS. 6 and 7, instead of the tines 146 or even the vertical rod portion 130, may be configured with an adapter at its distal end 134 having one or more receptacles with a hole analogous to the hole 70 of the capo body 30 and thereby receive one or more further attachments as selected by the user. As such, it will be appreciated that a modular system can be formed allowing for versatility in terms of the number and kinds of attachments that can be engaged with the capo apparatus 20 of the present invention.

Figure 8:
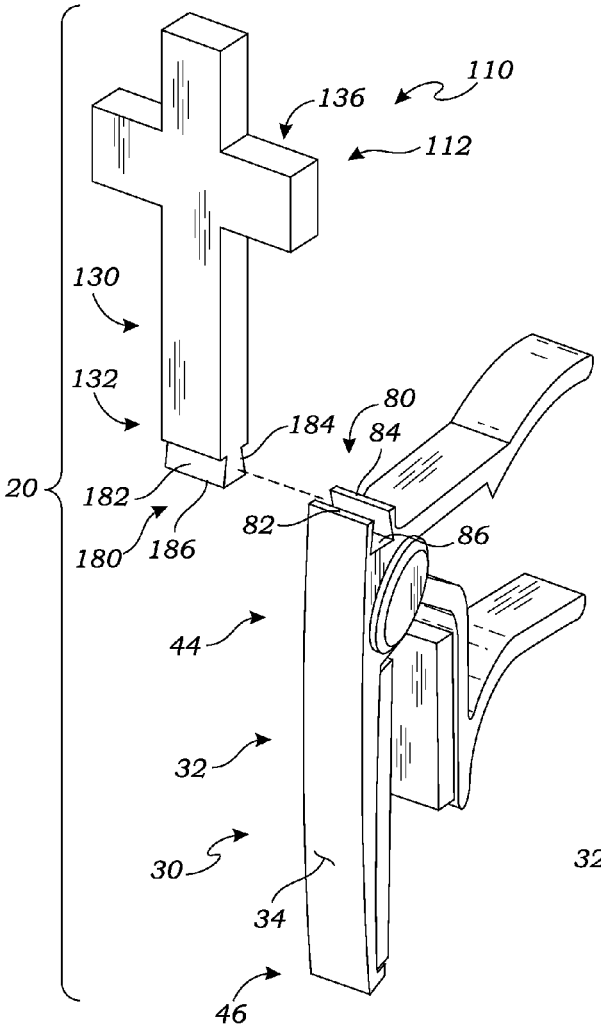
FIG. 8 is an exploded perspective view of a first alternative exemplary embodiment of the invention in conjunction with the exemplary first attachment thereof.
Figure 9:
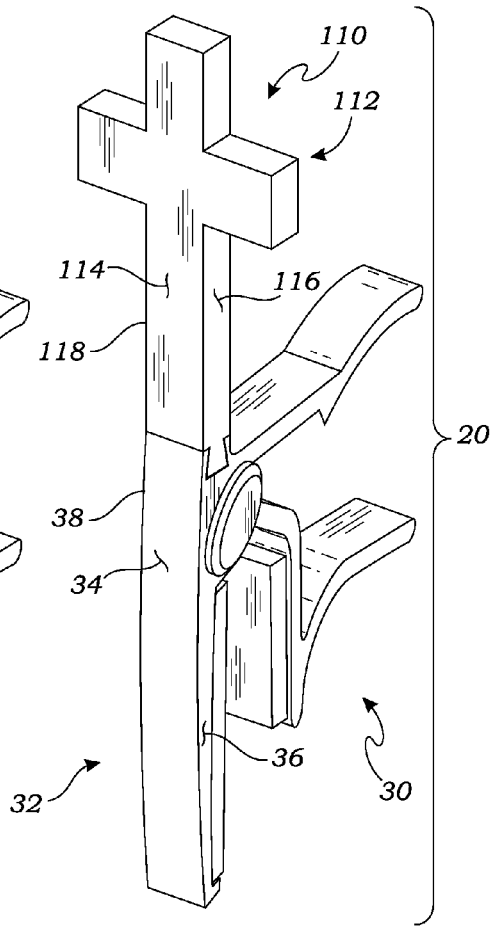
FIG. 9 is a perspective assembled view thereof with the exemplary first attachment of FIG. 8.

Turning next to FIGS. 8 and 9, there are shown exploded and assembled perspective views, respectively, of a further exemplary capo apparatus 20 according to aspects of the present invention wherein an attachment 110 with an attachment body 112 such as once more for illustration configured as a "cross" is again removably engaged with or installed on the capo body 30. Here, the capo body 30 is formed substantially at the proximal end 44 of the capo first leg 32 with a channel or slot 80. As shown in FIG. 8, the slot 80 is formed having a first side wall 82, an opposite, spaced-apart second side wall 84, and a bottom wall 86, with the first and second side walls 82, 84 preferably not being parallel, instead coming closer together as they extend away from the bottom wall 86 such that the slot 80 effectively forms a keyway. In the exemplary embodiment, the first side wall 82 is effectively coextensive with the capo first leg front surface 34. Accordingly, the vertical portion 130 of the attachment body 112 is formed at its proximal end 132 with a key 180 having a first side wall 182, an opposite second side wall 184, and a bottom wall 186. Preferably, the correspondence of the notch and key respective first side walls 82, 182, second side walls 84, 184, and bottom walls 86, 186 is such that the key 180 of the attachment 110 mates with the notch 80 of the capo body 30 as substantially a net fit so that the attachment 110 is keyed to and slidably engaged with the capo body 30. As shown in the assembled perspective view of FIG. 9, with the alternative attachment 110 and capo body 30 so engaged, as in the exemplary embodiment of FIGS. 2 and 3, the front surface 34, right side surface 36, and left side surface 38 of the first leg 32 of the capo body 30 are substantially coplanar or continuous with the front surface 114, right side surface 116, and left side surface 118 of the attachment body 112, respectively, so as to again give the front of the assembled capo apparatus 20 a substantially continuous look when the attachment 110 is installed on the capo body 30 as again shown in FIG. 9. Those skilled in the art will appreciate that such considerations are both functional and aesthetic and that, in any event, other such geometries and resulting looks may be employed in the capo apparatus 20 of the present invention without departing from its spirit and scope, including variations on the geometries and configurations of the slot 80 of the capo body 30 and the mating key 180 of the alternative exemplary attachment 110.

Figure 10:
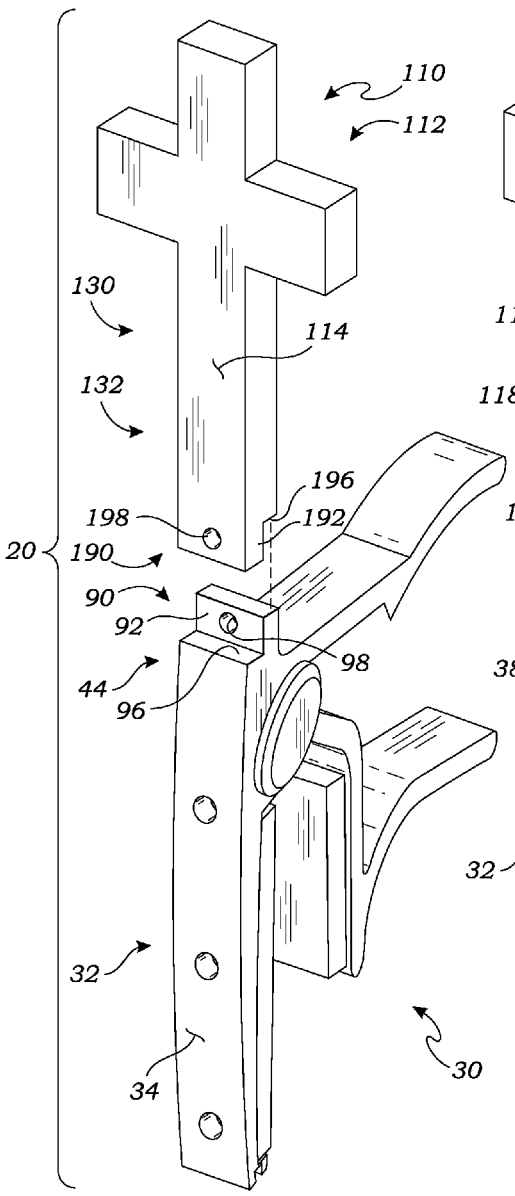
FIG. 10 is an exploded perspective view of a second alternative exemplary embodiment of the invention in conjunction with the exemplary first attachment thereof.
Figure 11:
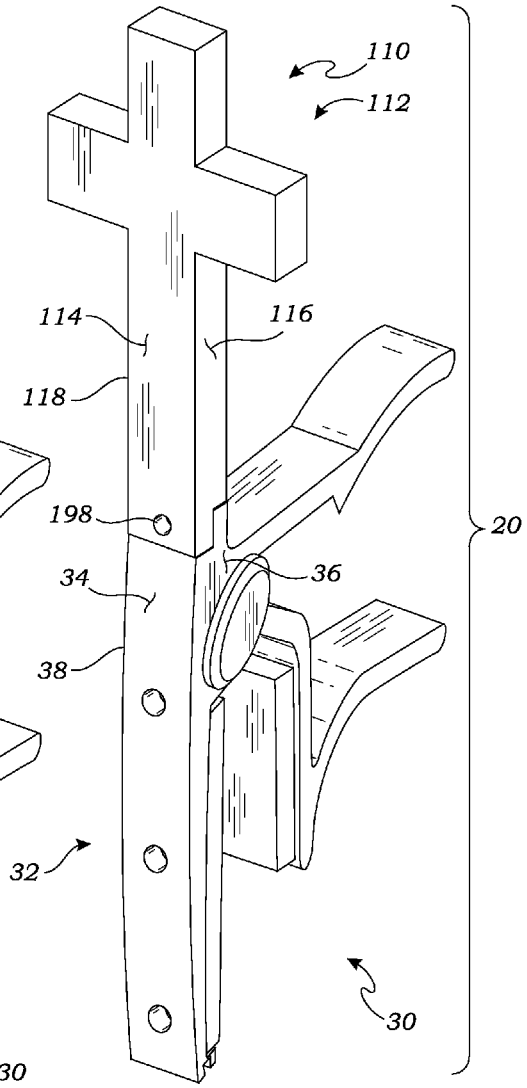
FIG. 11 is a perspective assembled view thereof with the exemplary first attachment of FIG. 10.

Similarly, turning now to FIGS. 10 and 11, there are shown exploded and assembled perspective views, respectively, of a still further exemplary capo apparatus 20 according to aspects of the present invention wherein an attachment 110 with an attachment body 112 such as once more for illustration configured as a "cross" is again removably engaged with or installed on the capo body 30. Here, the capo body 30 is formed substantially at the proximal end 44 of the capo first leg 32 with a first tab 90. As shown in FIG. 10, the first tab 90 is formed having a first tab side wall 92 and a first tab bottom wall 96, with a first tab hole 98 formed in the first tab side wall 92 substantially perpendicular thereto and to the front surface 34 of the capo first leg 32. Likewise, the vertical portion 130 of the attachment body 112 is formed at its proximal end 132 with a second tab 190 having a second tab side wall 192 and a second tab bottom wall 196, the second tab side wall 192 having a second tab hole 198 formed therein substantially perpendicular thereto and to the front surface 114 of the attachment body 112. The second tab side wall 192 is substantially horizontally offset from the first tab side wall 92 such that when the attachment 110 is mounted on the capo body 30 the side walls 92, 192 are brought into substantially abutting relationship, each further substantially seating against the respective bottom walls 196, 96. Preferably, the respective first and second tab holes 98, 198 are substantially aligned when the attachment 110 is positioned on the capo body 30 as shown in FIG. 11, whereby a bolt, screw, cross-pin, or other such fastener (not shown) can be positioned within or pass through the first and second tab holes 98, 198 so as to removably install the attachment 110 on the capo body 30. As shown in the assembled perspective view of FIG. 11, with the alternative attachment 110 and capo body 30 so engaged, once again as in the exemplary embodiment of FIGS. 2 and 3, the front surface 34, right side surface 36, and left side surface 38 of the first leg 32 of the capo body 30 are substantially coplanar or continuous with the front surface 114, right side surface 116, and left side surface 118 of the attachment body 112, respectively, so as to again give the front of the assembled capo apparatus 20 a substantially continuous look when the attachment 110 is installed on the capo body 30 as shown. Those skilled in the art will once again appreciate that such considerations are both functional and aesthetic and that, in any event, other such geometries and resulting looks may be employed in the capo apparatus 20 of the present invention without departing from its spirit and scope, including variations on the geometries and configurations of the first and second tabs 90, 190 of the capo body 30 and attachment 110, respectively.

Figure 12:
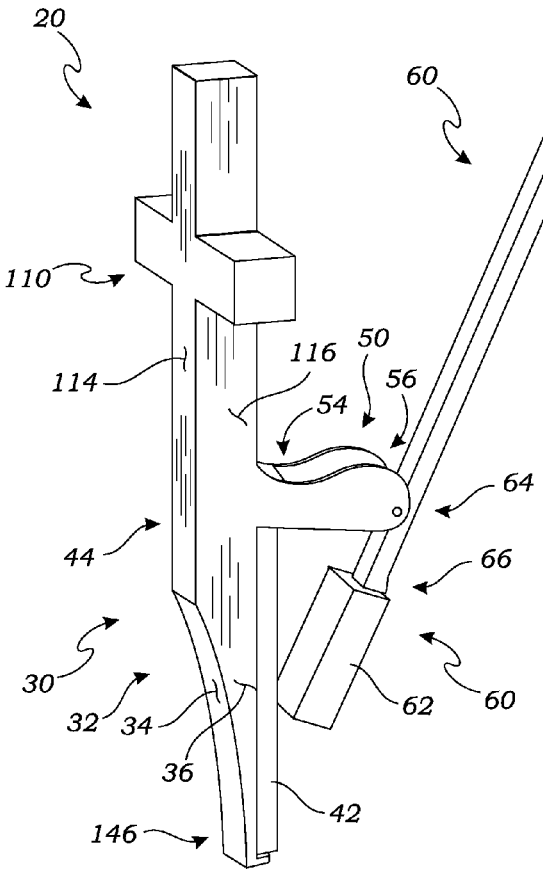
FIG. 12 is a perspective view of a third alternative exemplary embodiment of the invention.

Referring next to the perspective view of FIG. 12, there is shown a still further exemplary embodiment of a capo apparatus 20 according to aspects of the present invention wherein the capo body 30 and attachment 110 are integral. In this alternative exemplary embodiment, the capo body 30 is again formed having a first leg 32 and a substantially perpendicular second leg 50; more particularly, the first and second legs 32, 50 being joined substantially at the proximal ends 44, 54 thereof. The first leg is further formed toward its opposite distal end 46 with a substantially inwardly facing first leg pad 42, such pad 42 being positioned on the first leg 32 substantially opposite a first leg front surface 34. Pivotally attached substantially at the distal end 56 of the second leg 50 is an arm 60 substantially at its proximal end 64, the arm 60 being formed at its distal end 66 with a substantially axially extending and inwardly-facing arm pad 62. It will be appreciated that the first leg and arm pads 42, 62 are thus configured to face one another and in use of the capo apparatus 20 to clamp on the fret board F and neck N of a guitar G (FIG. 19) in a manner known in the art for changing the pitch or key of the instrument. Accordingly, as is also known in the art, the arm 60 may be biased toward the first leg 32 as by a spring or other device (not shown) for the purpose of clamping the capo apparatus 20 on the guitar neck N during use and may further be provided with an arm handle 68 configured to extend substantially axially from the proximal end 64 of the arm 60 opposite the pad 62 for the purpose of grasping the respective appendages, namely the handle 68 and attachment 110 for selectively pivoting the arm 60 against the resistance of the spring (not shown) for clamping and unclamping the capo apparatus 20 in a manner known in the art. Once again, those of ordinary skill in the art will appreciate that while one or more exemplary configurations of the capo apparatus 20 are shown and described, particularly as to its legs 32, 50 and arm 60, the invention is not so limited, but instead may take numerous forms employing a variety of components now known or later developed that are analogous or substantially functionally equivalent without departing from the spirit and scope of the invention.

Figure 13:
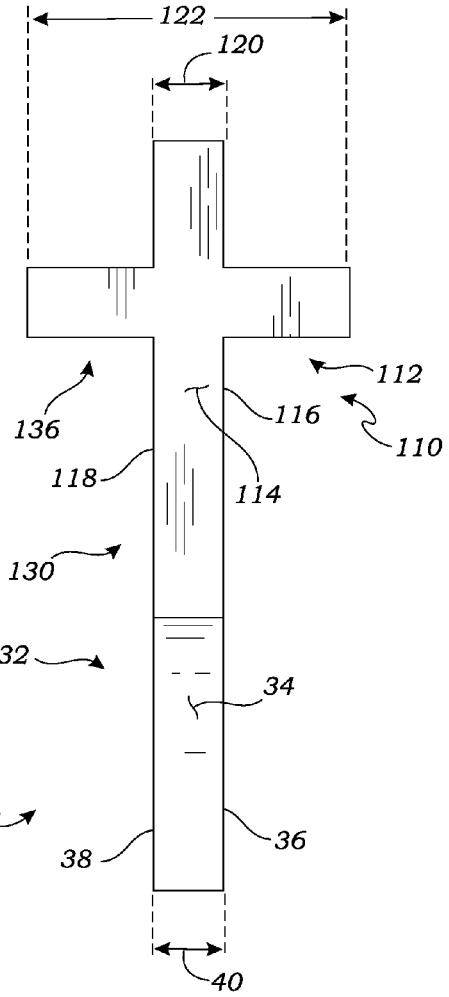
FIG. 13 is a front view thereof.
Figure 14:
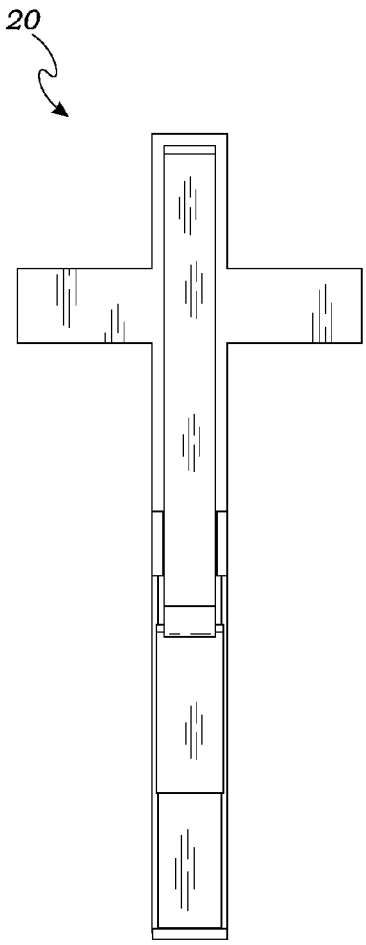
FIG. 14 is a back view thereof.
Figure 15:
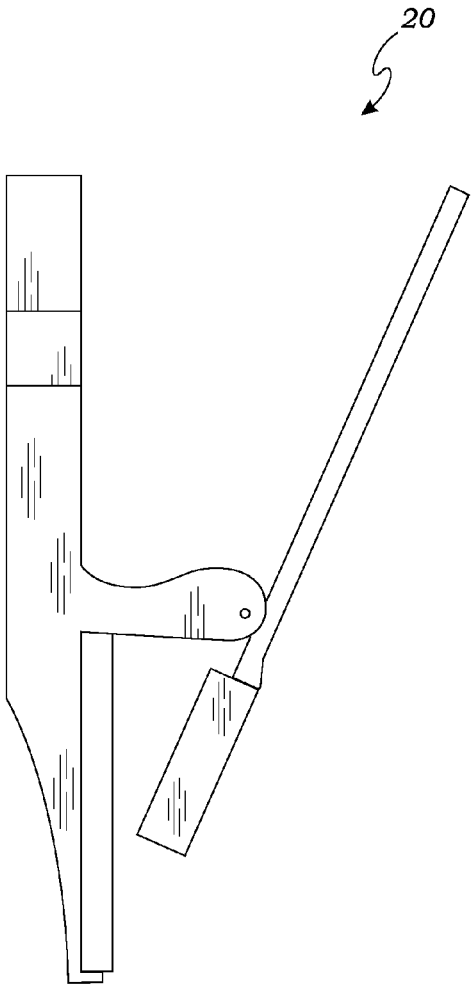
FIG. 15 is a right side view thereof.
Figure 16:
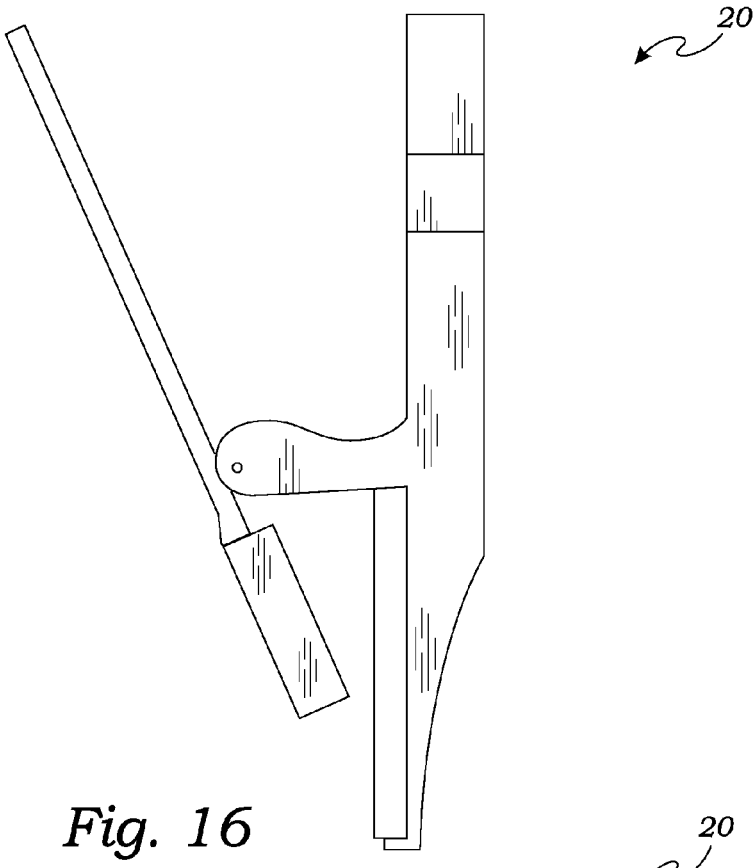
FIG. 16 is a left side view thereof.
Figure 17:
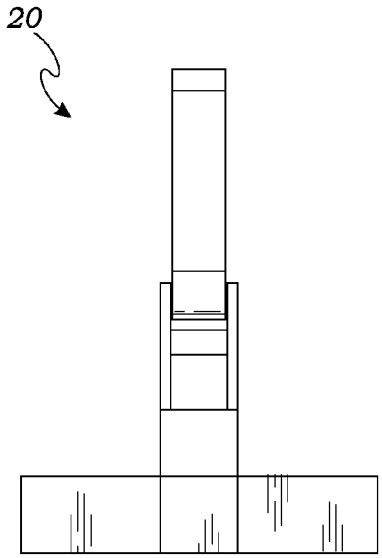
FIG. 17 is a top view thereof.
Figure 18:
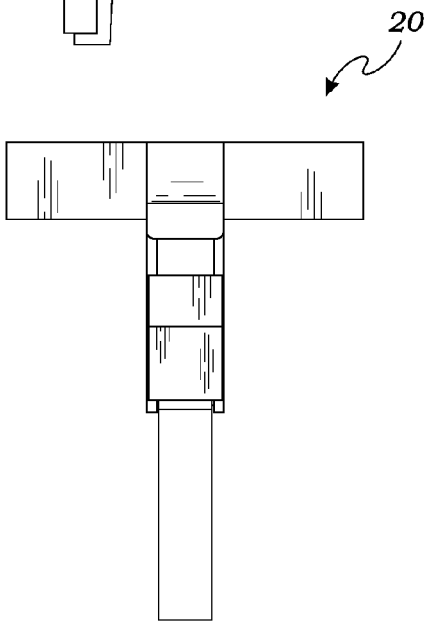
FIG. 18 is a bottom view thereof.

With continued reference to FIG. 12 and now with further reference to the front view of the alternative capo apparatus 20 shown in FIG. 13, the capo body 30 and attachment 110 here being integral, the first leg front surface 34, the first leg right side surface 36, and the first leg left side surface 38 of the capo first leg 32 are substantially continuous with the respective attachment front surface 114, attachment right side surface 116, and attachment left side surface 118. Accordingly, the first leg right and left side surfaces 36, 38 define a first leg width 40 effectively across the first leg front surface 34 that in the exemplary embodiment is substantially equivalent to an attachment first width 120 defined by the attachment right and left side surfaces 116, 118 effectively across the attachment front surface 114, so as to give the front of the assembled capo apparatus 20 a substantially continuous look. Those skilled in the art will appreciate that such considerations are both functional and aesthetic and that, in any event, other such geometries and resulting looks may be employed in the capo apparatus 20 of the present invention without departing from its spirit and scope. Relatedly, it will be appreciated that while the front and side surfaces of the respective capo body 30 and attachment 110 are shown as being substantially square or aligned, they need not be so; rather, the attachment 110 can be configured to be off-axis or out of plane with the capo body 30, and the capo first leg 32, particularly, and can essentially be placed on or extend anywhere from the capo body 30 that would not practically interfere with the playing of the guitar G (FIG. 19) or other stringed instrument such that the orientation of the attachment 110 relative to the capo body 30 in the exemplary embodiments is again to be understood as illustrative and non-limiting, as again is the configuration of the attachment 110 as a "cross" in the exemplary embodiments. Notably, once again, whether a cross or otherwise, it is shown that the horizontal portion 136 of the attachment 110 defines a second width 122 that is greater than the first width 120 associated with the vertical portion 130 of the attachment 110, or specifically the attachment body 112. As such, at least a portion of the attachment body 112 extends horizontally, or in a direction or plane substantially perpendicular to the capo body first leg 32 or substantially parallel to the neck N and strings S of the guitar G (FIG. 19), beyond the width 40 of the capo first leg 32. Relatedly, while the alternative capo apparatus 20 shown in FIG. 12 entails an integral attachment 110 with a variation on particularly the second leg 50, arm 60 and handle 68, it will be appreciated that the attachment 110 may also be removable in this alternative embodiment according to the other principles and aspects of the present invention as disclosed herein. Furthermore, whether integral or removably engaged, the capo body 30 and/or attachment 110 may further comprise a power source 100 and a light source 140 (FIG. 2) as well, and in any such embodiment as disclosed herein or other such embodiment consistent with or embodying one or more aspects of the present invention, it is to be appreciated that such components may be positioned in either or both the capo body 30 and/or attachment 110 so as to be rendered selectively operable.

FIGS. 14-18 show back, right side, left side, top, and bottom views of the exemplary capo apparatus 20 of FIG. 12.

Finally, referring now to the perspective view of FIG. 19 showing the alternative exemplary embodiment of the capo apparatus 20 of FIGS. 12-18 in use on a guitar G, the apparatus 20 is clamped on the guitar neck N in the conventional fashion whereby the pad 42 of the front leg 32 of the capo body 30 is made to contact the strings S substantially along the fret board F, typically between two frets, while the rear pad 62 integral with the arm 60 is brought into biased and abutting contact with the back side or surface of the neck N. As such and as shown, the attachment 110 of the capo apparatus 20, and specifically the attachment body 112, which is once again illustrated as a "cross," is substantially oriented in a plane parallel to the fret board F and substantially oriented vertically or perpendicular to the strings S. As such, while the guitar G is being played, the attachment body 112 of the capo apparatus 20 may be viewed by those watching the guitar G be played. Other functional and aesthetic benefits of such a multi-functional capo apparatus 20 are to be further appreciated with reference to the foregoing disclosure and appended drawing figures.

To summarize, regarding the exemplary embodiments of the present invention as shown and described herein, it will be appreciated that a capo apparatus is disclosed and configured for multi-functional use as through the incorporation of a removable or integral attachment. Because the principles of the invention may be practiced in a number of configurations beyond those shown and described, it is to be understood that the invention is not in any way limited by the exemplary embodiments, but is generally is able to take numerous forms to do so without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention. Furthermore, the various features of each of the above-described embodiments may be combined in any logical manner and are intended to be included within the scope of the present invention.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A capo apparatus for use on a stringed instrument comprising:

a capo body comprising a first leg having a first leg axis and a first leg surface with a first leg width thereacross, and further having a second leg at an angle to the first leg axis so as to extend away from the first leg surface, the first leg configured for being positioned adjacent a fret board of the stringed instrument such that the first leg surface faces substantially away from the fret board; and an attachment extending from the capo body, the attachment comprising an attachment body having an attachment axis and an attachment front surface defining an attachment first width associated with a vertical portion thereof and an attachment second width associated with a horizontal portion thereof, the attachment front surface being substantially parallel to the first leg surface such that the first leg width and the attachment first and second widths are substantially coplanar, the attachment second width being greater than the first leg width.

2. The apparatus of claim 1 further comprising a means for removably engaging the attachment with the capo body.

3. The apparatus of claim 2 wherein the removable engagement means comprises:

a hole formed in the capo body; and a post formed on the attachment body and configured for receipt within the hole, whereby engagement of the attachment with the capo body is accomplished through insertion of the post within the hole.

4. The apparatus of claim 3 wherein the hole is formed substantially at a first leg proximal end coaxial with the first leg axis and the post is formed substantially at an attachment vertical portion proximal end substantially coaxial with the attachment axis, whereby the first leg of the capo body and the vertical portion of the attachment body are substantially coaxial.

5. The apparatus of claim 3 further comprising an o-ring configured to seat in at least one of an outwardly-opening post groove formed in a substantially annular post wall of the post and an inwardly-opening hole groove formed in an internal hole wall of the hole.

6. The apparatus of claim 2 wherein the removable engagement means comprises:

a slot formed in the capo body having a slot first side wall, an opposite, spaced-apart slot second side wall, and a slot bottom wall, the slot first and second side walls tapering toward one another away from the slot bottom wall; and a mating key formed on the attachment body having a key first side wall, an opposite key second side wall, and a key bottom wall, the respective slot and key first side walls, slot and key second side walls, and slot and key bottom walls corresponding such that the key of the attachment mates with the notch of the capo body as substantially a net fit so that the attachment is keyed to and slidably engaged with the capo body.

7. The apparatus of claim 2 wherein the removable engagement means comprises:

a first tab formed on the capo body having a first tab side wall and a first tab bottom wall and a first tab hole formed in the first tab side wall substantially perpendicular thereto; and a second tab formed on the attachment body having a second tab side wall and a second tab bottom wall, the second tab side wall having a second tab hole formed therein substantially perpendicular thereto, the second tab side wall being substantially horizontally offset from the first tab side wall such that when the attachment is mounted on the capo body the respective first and second tab side walls are brought into substantially abutting relationship, each further substantially seating against the respective first and second tab bottom walls and the respective first and second tab holes thus being substantially aligned.

8. The apparatus of claim 2 further comprising:

a power source having a power source terminal positioned substantially within the first leg of the capo body substantially at a proximal end thereof such that the power source terminal extends substantially upwardly; and a light source having a light source terminal operably installed substantially within the attachment body substantially at a proximal end of the vertical portion thereof such that the light source terminal extends substantially downwardly, whereby upon engagement of the attachment with the capo body the respective power source and light source terminals are brought substantially into contact such that the power source powers the light source.

9. The apparatus of claim 8 further comprising a power switch in electrical communication with the power source so as to selectively control operation of the light source in a mode selected from the group consisting of on, off, and intermittent.

10. The apparatus of claim 8 wherein the attachment body is formed at least in part of a translucent material so as to allow light from the light source to pass therethrough.

11. The apparatus of claim 1 wherein the attachment first width is substantially equal to the first leg width so as to give the apparatus a substantially continuous appearance across the capo body and attachment.

12. The apparatus of claim 11 wherein:

the vertical portion of the attachment body is configured such that the first width is substantially constant thereallong representative of a vertical beam; and the horizontal portion of the attachment body is positioned so as to span the vertical portion between a proximal end and a distal end thereof substantially closer to the distal end representative of a horizontal beam, whereby the attachment has the appearance of a cross.

13. The apparatus of claim 1 further comprising:

a power source having a power source terminal positioned within the apparatus;

a light source having a light source terminal operably installed within the apparatus such that the light source terminal is substantially adjacent the power source terminal; and a power switch installed on the apparatus so as to selectively make electrical contact between the power source terminal and the light source terminal and thereby selectively power the light source.

14. The apparatus of claim 1 wherein the front surface of the attachment body is formed with indicia.

15. The apparatus of claim 1 wherein the vertical portion of the attachment body is formed at a distal end thereof with opposing tines forming a clip defining the horizontal portion.

16. The apparatus of claim 1 wherein:

the capo body and the attachment are integral; and the first leg axis and the attachment axis are substantially aligned, whereby the first leg and the vertical portion of the attachment body are substantially coaxial and coplanar.

17. The apparatus of claim 16 wherein the attachment first width is substantially equal to the first leg width so as to give the apparatus a substantially continuous appearance across the capo body and attachment.

18. A capo apparatus for use on a stringed instrument comprising:

a capo body comprising a first leg configured for being positioned adjacent a fret board of the stringed instrument;

an attachment extending from the capo body substantially from the first leg, the attachment comprising an attachment body formed at least in part of a translucent material;

a power source having a power source terminal positioned within one of the capo body and the attachment;

a light source having a light source terminal operably installed within one of the capo body and the attachment such that the light source terminal is substantially adjacent the power source terminal; and a power switch installed on the apparatus so as to selectively make electrical contact between the power source terminal and the light source terminal and thereby selectively power the light source so as to allow light from the light source to pass through the translucent material of the attachment body.

19. The apparatus of claim 18 wherein:

the capo body and the attachment are removably engaged;

the power source is positioned substantially within the first leg of the capo body substantially at a proximal end thereof such that the power source terminal extends substantially upwardly; and the light source is operably installed substantially within the attachment body substantially at a proximal end of a vertical portion thereof such that the light source terminal extends substantially downwardly, whereby upon engagement of the attachment with the capo body the respective power source and light source terminals are brought substantially into contact such that the power source selectively powers the light source.

20. A capo apparatus for use on a stringed instrument comprising:

a capo body comprising a first leg having a first leg axis and a first leg surface with a first leg width thereacross, and further having a second leg at an angle to the first leg axis so as to extend away from the first leg surface, the first leg configured for being positioned adjacent a fret board of the stringed instrument such that the first leg surface faces substantially away from the fret board;

an attachment extending from the capo body, the attachment comprising an attachment body having an attachment axis and an attachment front surface defining an attachment first width associated with a vertical portion thereof and an attachment second width associated with a horizontal portion thereof, the attachment front surface being substantially parallel to the first leg surface such that the first leg width and the attachment first and second widths are substantially coplanar, the attachment second width being greater than the first leg width; and a means for removably engaging the attachment with the capo body such that the first leg axis and the attachment axis are substantially aligned, whereby the first leg and the vertical portion of the attachment body are substantially parallel.

* * * * *